US010943571B2

(12) United States Patent
Sikra

(10) Patent No.: US 10,943,571 B2
(45) Date of Patent: Mar. 9, 2021

(54) MINI HI-HAT PEDAL SYSTEM

(71) Applicant: DRUM WORKSHOP, INC., Oxnard, CA (US)

(72) Inventor: Richard A. Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 133 days.

(21) Appl. No.: 15/873,269

(22) Filed: Jan. 17, 2018

(65) Prior Publication Data

US 2018/0204551 A1 Jul. 19, 2018

Related U.S. Application Data

(60) Provisional application No. 62/447,364, filed on Jan. 17, 2017.

(51) Int. Cl.
*G10D 13/02* (2020.01)
*G10D 13/065* (2020.01)

(52) U.S. Cl.
CPC ..... *G10D 13/065* (2013.01)

(58) Field of Classification Search
CPC ..... G10D 13/065
USPC ..... 84/422.3
See application file for complete search history.

(56) References Cited

U.S. PATENT DOCUMENTS 1,042,919 A 10/1912 Hughes
3,147,661 A * 9/1964 Padera ..... G10D 13/065 84/422.4
3,530,757 A 9/1970 Osuga
3,747,464 A * 7/1973 Russell ..... G10D 13/11 84/422.1
3,797,356 A 3/1974 Duffy et al.
4,145,951 A 3/1979 Kobayashi
4,198,894 A 4/1980 Della-Porta
4,200,025 A 4/1980 Currier
4,449,440 A 5/1984 Hoshino
4,488,471 A 12/1984 Youakim
4,517,876 A 5/1985 Duhon
(Continued)

FOREIGN PATENT DOCUMENTS

DE 202010004042 7/2010

OTHER PUBLICATIONS

U.S. Appl. No. 14/506,350, filed Oct. 3, 2014, Sikra.
(Continued)

*Primary Examiner* — Jianchun Qin
(74) *Attorney, Agent, or Firm* — Ferguson Case Orr Paterson

(57) ABSTRACT

Percussion assemblies, such as mini hi-hat percussion assemblies, are disclosed. The mini hi-hat assemblies can include a first connecting portion between a pedal and a drive shaft. A roller can be included between the first connecting portion and an underside of the pedal. Non-flexible members and/or flexible members such as a chain can be included between the drive shaft and a cymbal rod. Actuation of the pedal can cause rotation of the drive shaft and downward movement of the cymbal rod, which can have a top cymbal mounted thereon. This downward movement can cause the top cymbal to contact a bottom cymbal and produce a desired sound. A compression spring can then cause the system to rebound toward its equilibrium or resting position.

30 Claims, 2 Drawing Sheets

(56) References Cited

U.S. PATENT DOCUMENTS

| | | | | |
|---|---|---|---|---|
| 4,667,562 | A | 5/1987 | Lee | |
| 4,747,333 | A | 5/1988 | Hoshino | |
| 4,756,224 | A | 7/1988 | Lombardi | |
| 4,846,040 | A | 7/1989 | Hoshino | |
| 4,976,181 | A | 12/1990 | Hsieh | |
| 4,977,810 | A | 12/1990 | Hsieh | |
| 5,090,289 | A | 2/1992 | Holcomb | |
| 5,251,528 | A | 10/1993 | Kurosaki | |
| 5,301,592 | A | 4/1994 | Johnston | |
| 5,557,054 | A | 9/1996 | Shigenaga | |
| 5,646,360 | A | 7/1997 | Liao | |
| 5,789,688 | A | 8/1998 | Schiano | |
| 5,945,616 | A | 8/1999 | Hoshino | |
| 6,003,822 | A | 12/1999 | Kurosaki | |
| 6,031,170 | A | 2/2000 | Hoshino | |
| 6,166,312 | A | 12/2000 | Brewster | |
| 6,271,450 | B1 | 8/2001 | Mackie | |
| 6,278,046 | B1 | 8/2001 | Sikra | |
| 6,329,584 | B1 | 12/2001 | Liao | |
| 6,359,205 | B1 | 3/2002 | Lombardi | |
| 6,399,865 | B1 | 6/2002 | Ishimatsu | |
| 6,573,443 | B1 | 6/2003 | Chen | |
| 6,590,147 | B2 | 7/2003 | Kassabian | |
| 6,689,945 | B1 | 2/2004 | Matsuzoe | |
| 6,747,200 | B2 | 6/2004 | Sato | |
| 6,762,354 | B2 | 7/2004 | Cocca | |
| 6,794,565 | B2 | 9/2004 | Green | |
| 6,822,149 | B1 | 11/2004 | Liao | |
| 6,894,210 | B1 | 5/2005 | Lombardi | |
| 6,903,257 | B2 | 6/2005 | Yun | |
| 6,906,252 | B2 * | 6/2005 | Matsuzoe | G10D 13/11 84/422.2 |
| 6,930,232 | B2 | 8/2005 | Shigenaga | |
| 7,071,400 | B1 | 7/2006 | Lombardi | |
| 7,197,957 | B2 | 4/2007 | Gatzen | |
| 7,262,356 | B1 | 8/2007 | Lukios | |
| 7,301,088 | B2 | 11/2007 | Chen | |
| 7,365,258 | B1 | 4/2008 | Lombardi | |
| 7,371,953 | B2 | 5/2008 | Takegawa | |
| 7,399,916 | B1 | 7/2008 | Lombardi | |
| 7,405,352 | B2 | 7/2008 | Dorfman | |
| 7,449,626 | B2 | 11/2008 | Chen | |
| 7,456,351 | B2 | 11/2008 | Dorfman | |
| 7,511,212 | B1 | 3/2009 | Chang | |
| 7,579,540 | B2 | 8/2009 | Takegawa | |
| 7,626,107 | B1 | 12/2009 | Takegawa | |
| 7,633,000 | B2 | 12/2009 | Dorfman | |
| 7,671,262 | B1 | 3/2010 | Lin | |
| 7,737,352 | B2 | 6/2010 | Chang | |
| 7,928,305 | B1 | 4/2011 | Chen | |
| 7,956,268 | B1 | 6/2011 | Liao | |
| 7,968,781 | B1 | 6/2011 | Luo | |
| 7,999,165 | B2 | 8/2011 | Chen | |
| 8,063,293 | B1 | 11/2011 | Kjellgren | |
| 8,076,562 | B1 | 12/2011 | Lin | |
| 8,278,541 | B2 | 10/2012 | Dorfman | |
| 8,330,032 | B1 | 12/2012 | Sikra | |
| 8,410,346 | B2 | 4/2013 | Sassmannshausen | |
| 8,455,746 | B2 | 6/2013 | Johnston | |
| 8,624,097 | B1 | 1/2014 | Liao | |
| 8,735,705 | B1 | 5/2014 | Chen | |
| 8,859,870 | B2 | 10/2014 | Yamane | |
| 8,946,531 | B2 | 2/2015 | Nakata | |
| 8,993,865 | B2 | 3/2015 | Liao | |
| 9,087,497 | B1 | 7/2015 | Krol | |
| 9,460,692 | B2 | 10/2016 | Chen | |
| 9,466,272 | B1 | 10/2016 | Lin | |
| 9,472,174 | B2 | 10/2016 | Sikra | |
| D786,337 | S | 5/2017 | Chandontrikit | |
| 9,875,730 | B2 | 1/2018 | Cannon | |
| 2003/0209128 | A1 | 11/2003 | Hsieh | |
| 2004/0060421 | A1 | 4/2004 | Yun | |
| 2005/0150354 | A1 | 7/2005 | Paul | |
| 2006/0150801 | A1 | 7/2006 | Veiga | |
| 2006/0169124 | A1 | 8/2006 | Tanaka | |
| 2007/0113722 | A1 | 5/2007 | Chen | |
| 2008/0195574 | A1 | 8/2008 | Kjellgren | |
| 2008/0245210 | A1 | 10/2008 | Chang | |
| 2011/0067552 | A1 | 3/2011 | Chen | |
| 2011/0271618 | A1 | 11/2011 | Simon | |
| 2012/0097011 | A1 | 4/2012 | Leopold | |
| 2012/0144976 | A1 | 6/2012 | Johnston | |
| 2012/0180617 | A1 | 7/2012 | Dorfman | |
| 2012/0198984 | A1 | 8/2012 | Johnson | |
| 2014/0182445 | A1 | 7/2014 | Liao | |
| 2015/0059555 | A1 | 3/2015 | Liao | |
| 2015/0082968 | A1 | 3/2015 | Sikra | |
| 2015/0187343 | A1 | 7/2015 | Mori | |
| 2016/0063973 | A1 | 3/2016 | Lemieux | |
| 2016/0210946 | A1 * | 7/2016 | Sikra | G10D 13/11 |
| 2017/0124993 | A1 | 5/2017 | Sikra | |
| 2017/0206868 | A1 | 7/2017 | Sikra | |
| 2017/0236503 | A1 | 8/2017 | Sikra | |

OTHER PUBLICATIONS

U.S. Appl. No. 13/663,655, filed Oct. 30, 2012, Sikra.
U.S. Appl. No. 61/882,530, filed Sep. 25, 2013, Sikra.
U.S. Appl. No. 61/899,762, filed Nov. 4, 2013, Sikra.
DWCP3500 "Hi-Hat Stand" from Drum Workshop, Inc. available online at www.dwdrums.com, downloaded Feb. 3, 2015.
International Search Report and Written Opinion from Appl. No. PCT/US14/57383, dated Dec. 17, 2014.
Office Action for U.S. Appl. No. 15/583,173; dated Mar. 16, 2018.
DW Drums, DW 9000 Pedal Upgrades—Artist Testimonials, Youtube; Video (online), Nov. 5, 2012 (retrieved Mar. 15, 2017). Retrieved from the Internet: https://www.youtube.com/watch?v=B9zKsz93PVk>; 6:0093:13.
International Search Report and Written Opinion from patent appl. No. PCT/US17/13991, dated Apr. 6, 2017.
Office Action for U.S. Appl. No. 15/263,881; dated May 19, 2017.
Office Action for U.S. Appl. No. 15/409,428; dated Sep. 5, 2019.
Office Action for U.S. Appl. No. 15/409,428; dated Feb. 24, 2020.
International Search Report of Application No. PCT/US17/13993; dated Oct. 5, 2017.
Office Action of U.S. Appl. No. 15/409,428; dated Sep. 5, 2019.
Office Action of U.S. Appl. No. 15/409,428; dated Feb. 24, 2020.
Office Action of U.S. Appl. No. 16/255,503; dated Jul. 23, 2020.

* cited by examiner

MINI HI-HAT PEDAL SYSTEM

This application claims the priority of U.S. Provisional Pat. App. No. 62/447,364 to Sikra, entitled "Mini Hi-Hat Pedal System" and filed on Jan. 17, 2017, which is fully incorporated by reference herein in its entirety.

Systems, components, devices, and methods described in commonly owned U.S. Pat. App. Pub. No. 2017/0206868, filed on Jan. 18, 2017 and entitled "Percussion Pedal System," can be incorporated into systems according to the present disclosure, and that application is hereby incorporated by reference herein in its entirety.

BACKGROUND OF THE DISCLOSURE

Field of the Disclosure

Aspects of the present disclosure generally relate to percussion instruments, and more specifically, to percussion pedal systems such as a mini hi-hat pedal assembly.

Description of the Related Art

Musical notes have been created using many forms of instruments and devices. Percussion instruments, i.e., those that generate sound by being beaten, rattled, and/or vibrated, are sometimes considered to be the oldest type of musical instrument. There are many types of percussion instruments, the drum being one classic example.

A drum may be sounded by striking some portion of the drum with the hand. Some drums may also generate different tonal sounds when struck with a beater, mallet, or stick. Some musical genres utilize various different percussion sounds and tones to evoke different feelings in the listener; as such, different types of beaters, as well as the drummer's hand, may be used to produce various tones from a given drum.

Depending on the type of music being played, different tonal qualities of an instrument may be more desirable. For example, a flamenco style piece may emphasize different tonalities and tonal relationships between notes than a jazz style of music. Some musical pieces employ different consonance (relaxation and/or harmonization) and dissonance (tension and/or conflict) between the tonic (the central note of a chord or piece of music) and the other notes in a musical composition. As such, different beaters, or hand-beater combinations, may be desirable for some drums.

Some drums use foot-operated devices, sometimes referred to as "drum pedals" or "drum pedal assemblies" to operate and/or control a beater (also referred to as a "mallet" herein) that strikes a drum, or in the case of hi-hats, that cause the cymbals of the hi-hat to strike one another. A hi-hat is a common component of a drum set that can include two cymbals facing one another and mounted on a vertical tube or pole. A hi-hat can be operated in many different ways, including by a foot pedal which can cause the cymbals to strike one another, or by actuation using a drum stick, among other operation methods. The top and/or bottom cymbal can be adjustable so as to be mounted at different heights; in many prior art systems, the height of the top cymbal is adjustable. Adjustable cymbals can be attached to the tube using a clutch, which can aid in adjusting cymbal height. Some exemplary clutches are described, for example, in commonly owned U.S. Pat. App. Pub. No. 2015/0096430 to Sikra, filed on Oct. 3, 2014, which is fully incorporated by reference herein in its entirety. Either cymbal (or both cymbals) can be adjusted so as to be, for example, separated from the other cymbal, to be in loose contact with the other cymbal, or to be in tight contact with the other cymbal. Examples of hi-hats and pedals which can include components of the present disclosure and having components that can be included in systems according to the present disclosure are described, for example, in commonly owned U.S. Pat. App. Pub. No. 2016/0210946 to Sikra, filed on Jan. 20, 2016 and entitled "Hi-Hat Pedal Assembly," which is fully incorporated by reference herein in its entirety.

In certain instances, use of a "mini hi-hat" or "low-boy" can be desired. Some such prior art devices are described, for example, in U.S. Pat. No. 4,520,710 to Elliott, which is fully incorporated by reference herein in its entirety.

SUMMARY OF THE DISCLOSURE

One embodiment of a hi-hat pedal assembly according to the present disclosure can include a drive shaft and a pedal operably linked to the drive shaft by a first connecting portion such that actuation of the pedal causes rotation of the drive shaft. A second connecting portion can be between the drive shaft and a cymbal rod.

One embodiment of a mini hi-hat pedal assembly according to the present disclosure can include a base and a pedal on the base and rotatable about a hinge, with a drive shaft mounted on a drive shaft housing that is on the base. A first connecting portion can be between the pedal and the drive shaft, and can be operably connected to the drive shaft. A roller can be included between the first connecting portion and an underside of the pedal. Second, third, and fourth connecting portions can be included between the drive shaft and a cymbal rod, with the cymbal rod attached to the fourth connecting portion. A compression spring can be included on a spring bushing and a washer on the compression spring, each of the spring bushing, washer, compression spring, and cymbal rod being at least partially within a tube assembly. A top cymbal can be attached to the cymbal rod while a bottom cymbal can be on the tube assembly. Actuation of the pedal can cause movement of the roller, rotation of the drive shaft, downward movement of the cymbal rod, downward movement of the washer, downward movement of the top cymbal, and compression of the compression spring between the washer and the spring bushing.

Another embodiment of a hi-hat pedal assembly according to the present disclosure can include a drive shaft and a pedal operably linked to the drive shaft by a first connecting portion such that actuation of the pedal causes rotation of the drive shaft. The first connecting portion can be on a first side of the drive shaft while a second connecting portion can be on a second side of the drive shaft. The first and second connecting portions can be rigid.

The above summary has outlined, rather broadly, some features and technical advantages of the present disclosure such that the detailed description that follows may be better understood. Additional features and advantages of the disclosure will be described below. It should be appreciated by those skilled in the art that this disclosure may be readily utilized as a basis for modifying or designing other structures for carrying out the same or similar purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present disclosure, reference is now made to the following description taken in conjunction with the accompanying drawings.

DETAILED DESCRIPTION OF THE DISCLOSURE

Figure 2:
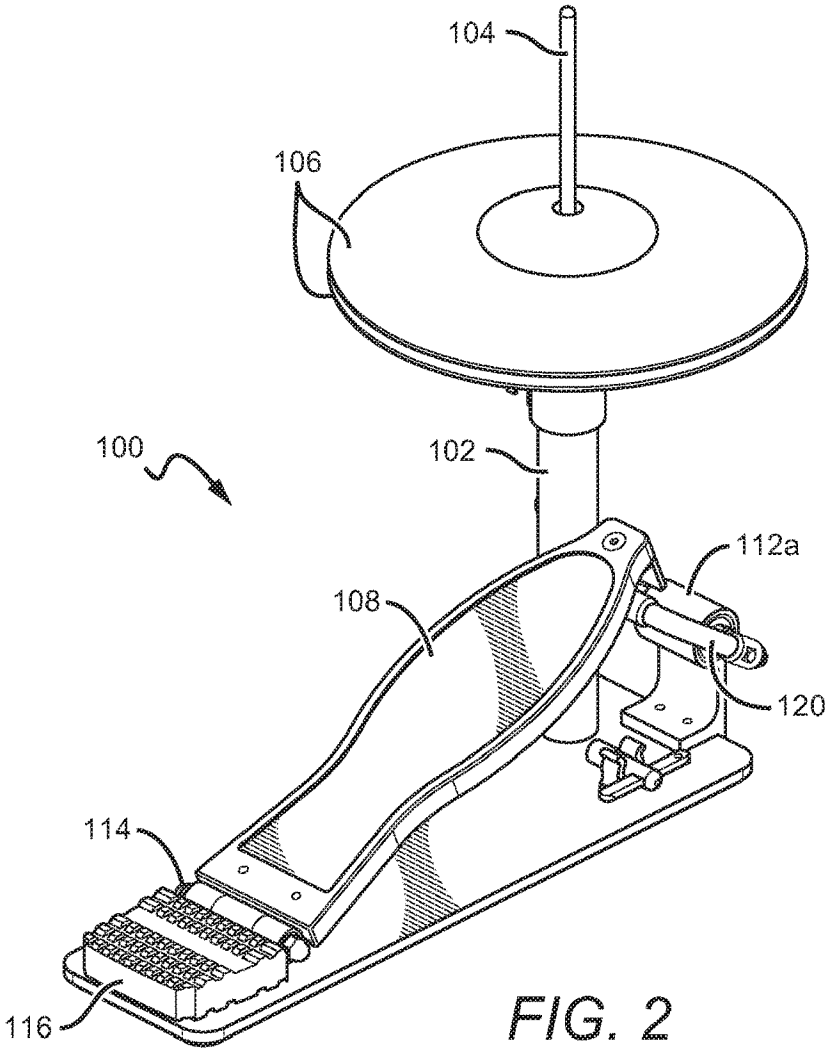
FIG. 2 shows a rear perspective view of the hi-hat pedal assembly shown in FIG. 1.

Some embodiments of the present disclosure are directed toward hi-hat pedal assemblies, such as mini hi-hat pedal assemblies, which include a drive shaft and connecting portions between the drive shaft and pedal and between the drive shaft and cymbal rod. The connecting portion(s) between the drive shaft and cymbal rod can include at least one chain. A roller can be included between the first connecting portion and the underside of the pedal. Actuation of the pedal can cause rotation of the drive shaft, downward movement of the cymbal rod, downward movement of a top cymbal, and compression of a spring such as a compression spring, potentially causing the top cymbal to contact a bottom cymbal and produce a sound. The compression spring can then cause the system to return to and/or rebound toward its equilibrium or resting position.

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent, however, to those reasonably skilled in the art that these concepts may be practiced without these specific details.

It is understood that when an element is referred to as being "on," "attached to," "connected to," or similar to another element, it can be directly on the other element or intervening elements may also be present. Further, when one element is referred to as being "connected" or "attached" to another element, it can be directly connected to the other element or intervening elements may also be present as would be understood by one of skill in the art. Furthermore, relative terms such as "inner", "outer", "upper", "top", "above", "lower", "bottom", "beneath", "below", and similar terms, may be used herein to describe a relationship of one element to another. Terms such as "higher", "lower", "wider", "narrower", and similar terms, may be used herein to describe angular and/or relative relationships. It is understood that these terms are intended to encompass different orientations of the elements or system in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present disclosure.

Embodiments of the disclosure are described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region and are not intended to limit the scope of the disclosure.

Figure 1:
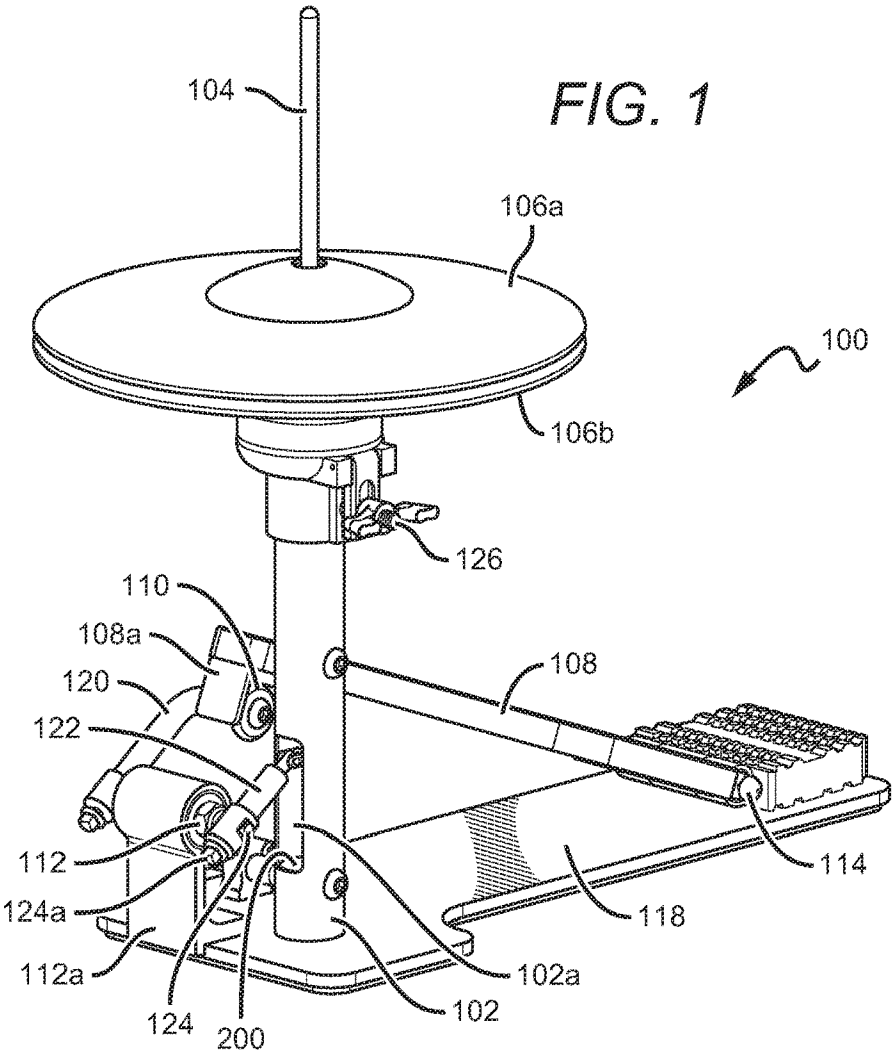
FIG. 1 shows a front perspective view of a hi-hat pedal assembly according to one embodiment of the present disclosure.
Figure 3:
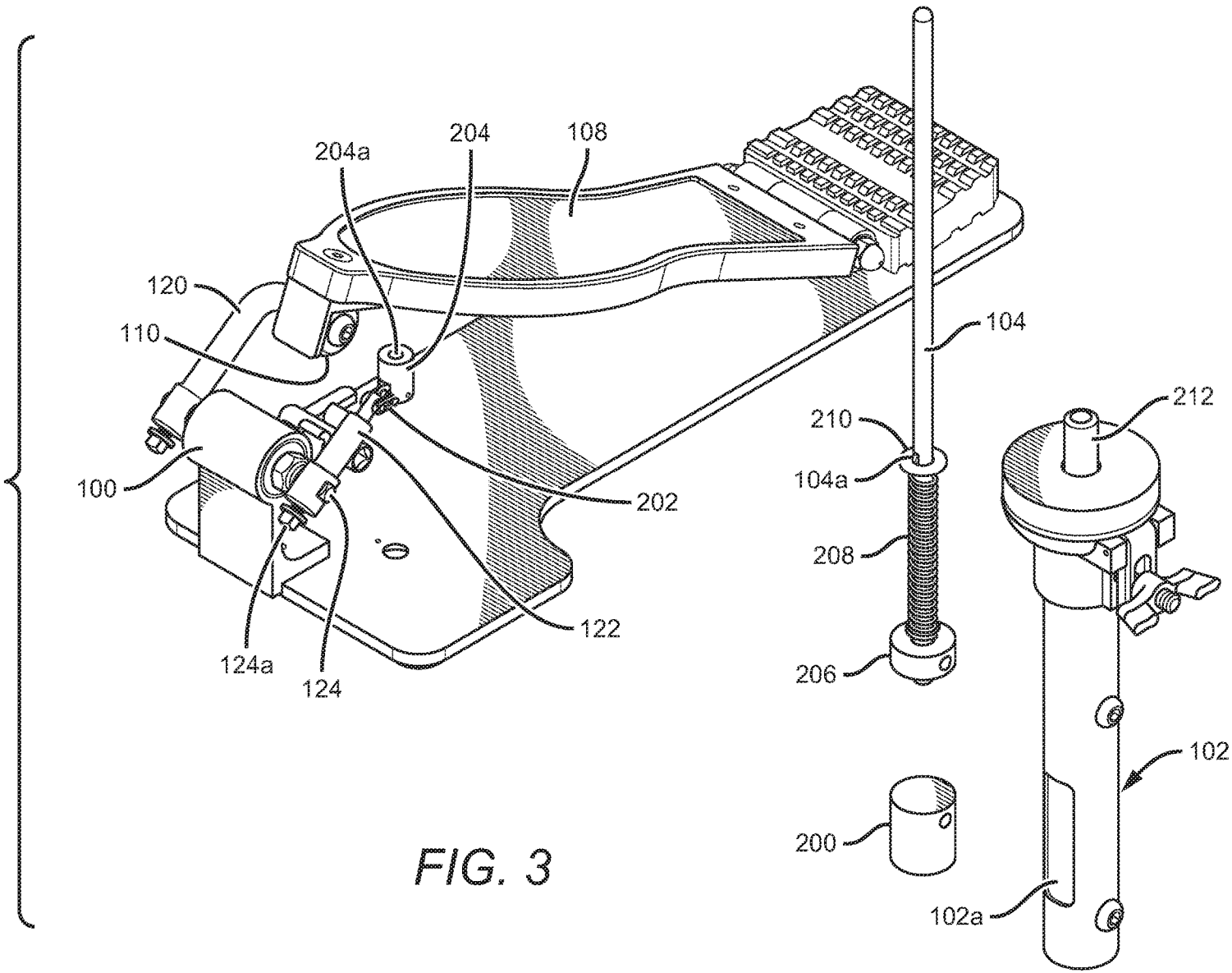
FIG. 3 shows an exploded perspective view of portions of the hi-hat pedal assembly shown in FIG. 1.

FIGS. 1-3 illustrate one embodiment of a percussion pedal system according to the present disclosure. In this specific case, the percussion pedal system is a mini hi-hat assembly 100, though it is understood that components described herein can be used for other types of systems and assemblies including but not limited to regular hi-hats. The mini hi-hat assembly 100 can have a total height of twenty-four inches or less, and in more specific embodiments can have a total height of eighteen inches or less, and in some specific embodiments can have a total height of between six and twenty-four inches, and in some more specific embodiments can have a total height of between twelve and eighteen inches, and in one specific embodiment can have a height of between fourteen and sixteen inches and/or a height of about fifteen inches. Embodiments outside of these ranges are also possible.

System 100 comprises a tube assembly 102, cymbal rod 104, cymbals 106 (including top cymbal 106*a* and bottom cymbal 106*b*), and pedal 108. Top cymbal 106*a* can be attached to cymbal rod 104, and cymbal rod 104 can be operably linked to pedal 108 such that actuation (e.g., depression) of pedal 108 causes cymbal rod 104—and thus top cymbal 106*a*—to move downward. This movement can cause top cymbal 106*a* and bottom cymbal 106*b* to strike one another, thus producing the desired sound. The bottom cymbal 106*b* can be a stationary cymbal. In other embodiments the top cymbal may be stationary and the bottom cymbal movable, such as via pedal actuation. In yet other embodiments both the top and bottom cymbals are movable.

As pedal 108 is pressed, pedal 108 rotates about an axis of hinge 114. Depression of pedal 108 also moves the opposite end of pedal 108 toward a base 118, thereby engaging roller 110. Roller 110 moves along a bottom surface of pedal 108 (e.g., a surface opposite where a user's foot typically engages pedal 108), and rotates or otherwise engages a drive shaft 112. First connecting portion 120 connects roller 110 to drive shaft 112 and transfers movement of the roller 110 and/or pedal 108 to drive shaft 112, and rotation of drive shaft 112 causes movement of a second connecting portion 122, such as rotation. Roller 110 may ride in a groove on pedal 108, a raised portion of pedal 108, or on any surface of pedal 108 to provide a specific feel and/or playing action to a drummer. Drive shaft 112 may also be coupled closer to hinge 114, or adjustable with respect to the distance between drive shaft 112 and hinge 114, to customize the height of pedal 108 when at a "rest" (not striking) position. The height of drive shaft 112 can also be adjusted, such as by adjusting the height of a stand 112*a* (which can be part of or constitute an overall drive shaft housing) on which the drive shaft 112 is mounted. In some embodiments of the present disclosure, drive shaft 112 can be six inches or less from a bottom of system 100; in some specific embodiments drive shaft 112 can be four inches or less from a bottom of system 100; in some specific embodiments drive shaft 112 can be three inches or less from a bottom of system 100; in some specific embodiments drive shaft 112 can be approximately two inches from a bottom of system 100; and in some specific embodiments drive shaft 112 can be approximately one to three inches from a bottom of system 100. It is understood that these ranges are exemplary and embodiments outside these ranges are possible.

Roller 110 provides a smooth movement of drive shaft 112. Such smooth movement of roller 110 on pedal 108 provides a better "feel" or "playing action" to a drummer playing a drum when employing system 100. The diameter and/or shape of roller 110 may be selected to provide a large movement of drive shaft 112 with a small movement of pedal 108, or may be selected to provide a linearly related (i.e., 1-to-1) movement of drive shaft 112 with movement of pedal 108. In one embodiment of the present disclosure, the roller has a diameter of between about 0.25 inch and 2 inches, and/or between about 0.5 inch and 1 inch, and/or about 0.75 inch, all inclusive. It is understood that these ranges are exemplary and embodiments outside these ranges are possible. Many possible relative movements of drive shaft 112 with respect to movement of pedal 108 are possible within the scope of the present disclosure. Further, roller 110 may have a cam or elliptical, oval, or other non-circular shape, and the position of the primary axis of roller 110 may be adjusted with respect to a resting position of pedal 108 to customize the motion of pedal 108 in generating motion in the cymbals 106. Embodiments not including a roller are also possible, and other operational connections between pedal 108 and connecting portion 120 and/or drive shaft 112 are possible, as would be understood by one of skill in the art. In the specific embodiment shown, it can be beneficial to connect to an underside of a pedal such as the pedal 108, at least because the drive shaft 112 is at a height below the end of the pedal 108 and the first connecting portion 120 rises from the drive shaft 112 to the pedal 108. Other embodiments are possible.

First and second connecting portions or arms 120, 122 (referred to hereinafter as "connecting portions" for simplicity) can be connected to drive shaft 112 in any number of different manners. In an aspect of the present disclosure, first connecting portion 120 couples roller 110 to drive shaft 112. Drive shaft 112 is coupled to second connecting portion 122, and can be secured to second connecting portion 122 with connection 124 which can include a nut 124*a*, with the specific embodiment shown including a post-and-aperture connection 124 that can be many different shapes, and is shown as square. Other shapes including regular and irregular polygons of three sides, four sides, five sides, 6 sides, 8 sides, or any number of sides are possible, as are non-polygon shapes. Pedal 108 may optionally comprise a stop 108*a* to stop roller 110 from disengaging from pedal 108 and/or to set a maximum position of pedal 108.

As pedal 108 is actuated and drive shaft 112 rotates (as shown in FIG. 1, clockwise) and first connection portion 120 rotates downward/clockwise, second connecting portion 122 also rotates downward/clockwise, causing movement of cymbal rod 104 and top cymbal 106*a* downward. If the pedal 108 is actuated a far enough rotational distance, top cymbal 106*a* strikes bottom cymbal 106*b*.

FIG. 3 shows inner componentry of mini hi-hat pedal assembly 100. Second connecting portion 122 can in some embodiments be directly attached to cymbal rod 104, or can be attached via other components. For example, as shown in FIG. 3 a third connecting portion 202 can connect second connecting portion 122 to a fourth connecting portion 204, and fourth connecting portion 204 can connect to cymbal rod 104. For example, a bottom end of cymbal rod 104 can be attached to and/or within an aperture 204*a* of fourth connecting portion 204 (or of another component if a fourth connecting portion 204 is not present). In the specific embodiment shown third connecting portion 202 is a flexible member, shown in FIG. 3 as a chain, although many other flexible members such as cables, ropes, wires, straps, bands, etc. are possible, and stiff and/or non-flexible members are also possible. Use of a flexible member such as a chain provides a larger amount of "play" or "lag" when playing system 100, which can be desirable for certain playing styles. Rigid and/or non-flexible members will have less play or lag, which can be desirable for other playing styles. While the specific embodiment shown includes three connecting portions on the cymbal-side of the drive shaft (as opposed to the pedal-side), it is understood that any number of connecting portions, one or more, may be used. Further, any combination of flexible and rigid members is possible. In one embodiment, a single flexible member such as a chain is used. In another embodiment, a single rigid member is used. In the embodiment shown, a rigid-flexible-rigid combination is used. In another embodiment, a rigid-flexible combination is used. All combinations are possible. Further, all such combinations are also possible on the pedal-side of the drive shaft. While the embodiment shown utilizes a single rigid member, a single flexible member could be used and attached to pedal 108, or any combination as previously described could be used. Additionally, tube assembly 102 can include an aperture 102*a* for providing access to said cymbal rod and/or other elements. It is also understood that the pedal-side of the system can be used with different cymbal-sides than the one shown, and the shown cymbal-side of the system can be used with different pedal-sides than shown.

In an aspect of the present disclosure, actuation and/or pressure on pedal 108 moves roller along pedal 108 towards hinge 114, which moves first connecting portion 120 that is attached to roller 110. As first connecting portion 120 moves, drive shaft 112 is rotated, which rotates second connecting portion 122. The rotation of second connecting portion 122, which is a clockwise rotation in the perspective of FIG. 1, pulls third connecting portion 202 and fourth connecting portion 204, and thus cymbal rod 104, downward.

The relative angles of coupling between first connecting portion 120 and drive shaft 112 (e.g., the angle the first connecting portion 120 makes with the horizontal while at rest), and/or the coupling angle between second connecting portion 122 and drive shaft 112, may affect the engagement point of pedal 108 with respect to movement of cymbal rod 104 (i.e., the point of actuation where movement of pedal 108 starts causing movement of cymbal rod 104) and/or the resting position of pedal 108). These two couplings angles are equal in the specific embodiment shown, but other embodiments where the coupling angles are not equal are possible. Further, the length and/or angle of the first connecting portion 120 (between roller 110 and drive shaft 112), length of the connecting portions 122, 202, 204, size of roller 110, and/or other features of may also be adjusted to change the engagement point of pedal 108 in terms of motion of cymbal rod 104. The adjustment of the engagement point of pedal 108 is important to drummers, in that different engagement points will raise or lower the height of pedal 108 with respect to base 118. Via such adjustments, the amount of movement of pedal 108 that must be undertaken to produce sound from contact of cymbals 106 can also be varied. These adjustments allow for customization of the system 100 to each individual drummer, as well as different types of drums, without producing several different types of systems 100. Further, it is understood that many other pedal portions/components can be used as part of systems according to the present disclosures, such as pedals and components described in commonly owned U.S. Pat. App. Pub. No. 2015/0082968 to Sikra, commonly owned U.S. Pat. App. Pub. No. 2016/0210946 to Sikra, and commonly owned U.S. Pat. App. Pub. No. 2017/0124993 to Sikra, each of which is fully incorporated by reference herein in its entirety.

As described above, actuation of pedal 108 causes downward motion of cymbal rod 104. Cymbal rod 104 can be operably linked to a spring 208, which can be a compression spring, such that downward movement of cymbal rod 104 causes compression of spring 208, which can be mounted on and/or around cymbal rod 104 and/or be mounted on a spring bushing 206. For example, in the embodiment shown cymbal rod 104 includes protrusions 104*a* which are on top of and/or over a washer 210 that is mounted on cymbal rod 104. Downward movement of cymbal rod 104 causes downward movement of washer 210, which causes spring 208 to be compressed between washer 210 and spring bushing 206. The biasing of spring 208 can then cause the cymbal rod 104 and/or top cymbal 106*a* to rebound upward toward its equilibrium or resting position, and to eventually reach its equilibrium or resting position should outside forces (such as an additional pedal actuation) not act upon the system. Spring bushing 206 can in some embodiments be stationary and/or mounted within tube assembly 102, though other embodiments are possible. Use of a flexible connecting portion like a chain, as with the third connecting portion 202, can cause there to be more play and rebound oscillation, whereas the use of rigid connecting portions can cause less play and rebound oscillation. It is understood that components other than washers and spring bushings can also accomplish these functions as would be understood by one of skill in the art, and these components may or may not be present. Further, it is understood that the system can instead utilize a tension spring with appropriate modifications, such as pedal actuation causing upward movement of a cymbal rod and bottom cymbal which lengthens the tension spring, the tension spring then causing a downward rebound of the cymbal rod.

System 100 can also include a tube bushing 200. Tube bushing 200 can be used as a stop and can stop downward movement of cymbal rod 104 at a certain height (i.e., the height of the top of the tube bushing 200). System 100 can also include a cymbal adjustment system 126, such as a cymbal adjustment system as described in commonly owned U.S. Pat. No. 6,570,075 to Lombardi, which is fully incorporated by reference herein in its entirety.

Although the present disclosure and its advantages have been described in detail, it should be understood that various changes, substitutions and alterations can be made herein without departing from the technology of the disclosure as defined by the appended claims. For example, relational terms, such as "above" and "below" are used with respect to a device. Of course, if the device is inverted, above becomes below, and vice versa. Additionally, if oriented sideways, above and below may refer to sides of a device. Moreover, the scope of the present application is not intended to be limited to the particular configurations of the process, machine, manufacture, composition of matter, means, methods and steps described in the specification. As one of ordinary skill will readily appreciate from the disclosure, processes, machines, manufacture, compositions of matter, means, methods, or steps, presently existing or later to be developed that perform substantially the same function or achieve substantially the same result as the corresponding configurations described herein may be utilized according to the present disclosure. Accordingly, the appended claims are intended to include within their scope such processes, machines, manufacture, compositions of matter, means, methods, or steps.

The description of the disclosure is provided to enable any person of reasonable skill to make or use the disclosure. Various modifications to the disclosure will be readily apparent to those of reasonable skilled, and the generic principles defined herein may be applied to other variations without departing from the spirit or scope of the disclosure. Thus, the disclosure is not intended to be limited to the examples and designs described herein but is to be accorded the widest scope consistent with the principles and novel features disclosed herein. Accordingly, the disclosure is not to be limited by the examples presented herein, but is envisioned as encompassing the scope described in the appended claims and the full range of equivalents of the appended claims.

I claim:

1. A hi-hat pedal assembly, comprising:

a base plate;

a rotatable drive shaft mounted in or on a drive shaft housing, said drive shaft housing mounted on said base plate;

a pedal mounted on said base plate, rotatable about a hinge, and comprising a pedal end opposite said hinge, said pedal operably linked to said drive shaft by a first connecting portion such that actuation of said pedal causes rotation of said drive shaft;

a cymbal rod; and a second connecting portion between said drive shaft and said cymbal rod;

wherein said drive shaft is at a height below said pedal end.

2. The hi-hat pedal assembly of claim 1, wherein said second connecting portion is a chain.

3. The hi-hat pedal assembly of claim 1, further comprising a third connecting portion and a fourth connecting portion, said third connecting portion between said drive shaft and said second connecting portion, and said fourth connecting portion between said second connecting portion and said cymbal rod, said cymbal rod attached to said fourth connecting portion;

wherein each of said third connecting portion and said fourth connecting portion is rigid; and wherein said second connecting portion is flexible.

4. The hi-hat pedal assembly of claim 1, wherein said cymbal rod is through a compression spring and through a spring bushing, said compression spring on said spring bushing, and wherein downward movement of said cymbal rod causes downward movement of a top of said compression spring toward said spring bushing.

5. The hi-hat pedal assembly of claim 1, wherein said first connecting portion rises from said drive shaft to said pedal.

6. The hi-hat pedal assembly of claim 1, further comprising a roller between said first connecting portion and an underside of said pedal, wherein said roller is configured to move along said underside of said pedal.

7. The hi-hat pedal assembly of claim 1, wherein said drive shaft housing holds said drive shaft at a height of six inches or less from a bottom of said hi-hat pedal assembly.

8. The hi-hat pedal assembly of claim 1, wherein said drive shaft is six inches or less from a bottom of said hi-hat pedal assembly.

9. The hi-hat pedal assembly of claim 1, wherein said hi-hat pedal assembly has a height of twenty-four inches or less.

10. The hi-hat pedal assembly of claim 1, wherein said cymbal rod is mounted through a tube assembly, and further comprising:

a top cymbal attached to said cymbal rod; and a bottom cymbal on said tube assembly, wherein downward motion of said cymbal rod causes downward motion of said top cymbal.

11. The hi-hat pedal assembly of claim 1, wherein said cymbal rod is through a compression spring, wherein actuation of said pedal causes downward motion of said cymbal rod, and wherein downward motion of said cymbal rod causes downward movement of a top of said compression spring.

12. The hi-hat pedal assembly of claim 1, wherein said cymbal rod is through a tube assembly, and further comprising:

a top cymbal attached to said cymbal rod; and a bottom cymbal on said tube assembly, wherein actuation of said pedal further causes downward motion of said cymbal rod and downward motion of said top cymbal.

13. The hi-hat pedal assembly of claim 1, wherein said first connecting portion extends forward from said pedal toward a first end of said drive shaft, and said second connecting portion extends rearward from a second end of said drive shaft toward said cymbal rod.

14. The hi-hat pedal assembly of claim 1, wherein said drive shaft comprises a central axis, and wherein said drive shaft is rotatable about said central axis.

15. A percussion pedal assembly, comprising:

a base;

a pedal on said base and rotatable about a hinge;

a drive shaft mounted on a drive shaft housing, said drive shaft housing on said base;

a first connecting portion between said pedal and said drive shaft, said first connecting portion operably connected to said drive shaft;

a roller between said first connecting portion and an underside of said pedal;

a second connecting portion between said drive shaft and a cymbal rod, said cymbal rod through a compression spring;

a top cymbal attached to said cymbal rod; and a bottom cymbal below said top cymbal;

wherein actuation of said pedal causes movement of said roller along a bottom surface of said pedal, rotation of said drive shaft, downward movement of said cymbal rod, downward movement of said top cymbal toward said bottom cymbal, and compression of said compression spring.

16. The percussion pedal assembly of claim 15, further comprising a third connecting portion between said second connecting portion and said cymbal rod.

17. The percussion pedal assembly of claim 16, further comprising a fourth connecting portion between said third connecting portion and said cymbal rod, said cymbal rod attached to said fourth connecting portion.

18. The percussion pedal assembly of claim 17, wherein said third connecting portion is a chain.

19. The percussion pedal assembly of claim 17, wherein each of said first, second, and fourth connecting portions is rigid.

20. The percussion pedal assembly of claim 15, wherein said percussion pedal assembly is a mini hi-hat assembly.

21. The percussion pedal assembly of claim 15, wherein said roller is circular.

22. The percussion pedal assembly of claim 15, wherein said roller is a wheel.

23. The percussion pedal assembly of claim 15, wherein said compression spring is on a spring bushing and further comprising a washer on said compression spring, wherein actuation of said pedal causes downward movement of said washer and compression of said compression spring between said washer and said spring bushing.

24. The percussion pedal assembly of claim 15, wherein said compression spring and said cymbal rod are at least partially within a tube assembly, said tube assembly on said base.

25. The percussion pedal assembly of claim 15, further comprising a stop extending downward from said pedal to prevent said roller from disengaging said pedal.

26. A percussion pedal assembly, comprising:

a base;

a drum pedal on said base and rotatable about a hinge;

a drive shaft mounted on a drive shaft housing, said drive shaft housing mounted on said base;

a first connecting portion extending forward from said drum pedal to a first end of said drive shaft;

a roller between said first connecting portion and an underside of said drum pedal; and a second connecting portion connected to a second end of said drive shaft, said second connecting portion extending rearward from said second end of said drive shaft;

wherein actuation of said drum pedal causes movement of said first connecting portion, movement of said roller along a bottom surface of said drum pedal, and movement of said second connecting portion.

27. The percussion pedal assembly of claim 26, wherein said drive shaft is mounted at a height below an end of said drum pedal opposite said hinge.

28. The percussion pedal assembly of claim 26, wherein said drive shaft is rotatable.

29. The percussion pedal assembly of claim 26, wherein said drive shaft comprises a central axis, and wherein said drive shaft is rotatable about said central axis.

30. The percussion pedal assembly of claim 26, further comprising a cymbal rod, wherein said second connecting portion extends rearward from said second end of said drive shaft toward said cymbal rod, and wherein actuation of said drum pedal also causes downward movement of said cymbal rod.

* * * * *